US007955131B2

(12) United States Patent
Barbier et al.

(10) Patent No.: US 7,955,131 B2
(45) Date of Patent: Jun. 7, 2011

(54) ACCESSORY OF THE BACKSHELL TYPE FOR CONNECTOR

(75) Inventors: Cyril Barbier, Le Pont de Claix (FR); Emmanuel Demaret, Rochecorbon (FR); Marnix Van Der Mee, Montlouis sur Loire (FR)

(73) Assignee: Radiall, Rosny Sous Bois (FR)

( * ) Notice: Subject to any disclaimer, the term of this patent is extended or adjusted under 35 U.S.C. 154(b) by 0 days.

(21) Appl. No.: 12/593,748

(22) PCT Filed: Apr. 3, 2008

(86) PCT No.: PCT/FR2008/050587

§ 371 (c)(1),
(2), (4) Date: Nov. 10, 2009

(87) PCT Pub. No.: WO2008/145878

PCT Pub. Date: Dec. 4, 2008

(65) Prior Publication Data

US 2010/0093214 A1 Apr. 15, 2010

(30) Foreign Application Priority Data

Apr. 4, 2007 (FR) ..... 07 54277

(51) Int. Cl.
*H01R 13/648* (2006.01)

(52) U.S. Cl. ..... 439/607.17

(58) Field of Classification Search ..... 439/607.17, 439/436–441, 395

See application file for complete search history.

(56) References Cited

U.S. PATENT DOCUMENTS

| | | | | |
|---|---|---|---|---|
| 3,744,007 | A | 7/1973 | Horak | |
| 3,830,957 | A * | 8/1974 | Oberdiear | 174/78 |
| 4,547,623 | A * | 10/1985 | Van Brunt et al. | 174/359 |
| 5,102,351 | A * | 4/1992 | Meshel | 439/607.01 |
| 5,237,129 | A * | 8/1993 | Obara | 174/667 |
| 5,278,352 | A | 1/1994 | Schade | |
| 5,466,890 | A * | 11/1995 | Stagnitti | 174/84 R |
| 5,580,278 | A | 12/1996 | Fowler et al. | |
| 5,691,506 | A * | 11/1997 | Miyazaki et al. | 174/652 |
| 6,116,955 | A | 9/2000 | Lazaro, Jr. | |
| 7,114,986 | B1 * | 10/2006 | Toly | 439/441 |
| 7,175,469 | B1 * | 2/2007 | Daily et al. | 439/441 |

FOREIGN PATENT DOCUMENTS

GB 1 206 362 9/1970

* cited by examiner

*Primary Examiner* — Jean F Duverne
(74) *Attorney, Agent, or Firm* — Oliff & Berridge, PLC

(57) ABSTRACT

The invention relates to an accessory intended to be assembled to a connector along an assembly axis, comprising:

a main body (20), at least one deformable contact element (60) comprising a contact part (70) intended to exert, after assembling the accessory (10) to the connector (90), pressure on an electrically conducting surface of said connector and a part intended to be in contact, after assembling the accessory to said connector, with said main body, said contact element being able to ensure electrical connection between said parts, characterized in that it furthermore comprises pressure means able to push said contact part in such a way as to increase said pressure.

25 Claims, 2 Drawing Sheets

ACCESSORY OF THE BACKSHELL TYPE FOR CONNECTOR

The invention relates to an accessory, in particular of the "backshell" type, designed to be assembled to a connector. Such an accessory is, in particular, designed for the attachment of one or more electrical cables to the connector.

Conventionally, an accessory comprises a main body whose general shape is substantially cylindrical and a lock nut locked axially relative to the main body by means of a retention ring.

The nut is designed to be fixed to a thread of a circular connector.

In order to prevent rotation between the accessory and the connector, these parts are also conventionally provided with teeth capable of interlocking with one another when they are axially brought together by the screwing of the nut onto the connector.

Most of the accessories mounted on circular connectors achieve an axial electrical contact at the interface between the teeth of the accessory and the teeth of the connector. Certain teeth may however not be in contact or have a reduced contact surface with the teeth between which they are placed.

In the event of a lightning discharge, devastating electric arcs may then form between the teeth of the accessory and the teeth of the connector if there is not a clear contact between them.

To limit this formation of electric arcs, other accessories are known that are provided with metal lugs capable of ensuring, by elastic pressure, a substantially radial electrical contact at a lateral surface of the connector, with the connector. The incorporating of such contact lugs is for example described in U.S. Pat. No. 5,580,278.

The quality of the electrical contact provided by these contact lugs depends on the pressure that they apply to the lateral surface of the connector. However, any increase in this pressure leads to making it more difficult to couple the accessory to the connector, the operator then having to apply an increased axial force to insert the connector between the contact lugs.

There is therefore a need for an accessory capable of being assembled to a connector, in particular a circular connector, that is capable of providing effective protection in the event of a lightning discharge and which is easy to assembly to the connector.

The object of the invention is to satisfy this need.

According to the invention, this object is achieved by means of an accessory designed to be assembled to a connector on an assembly axis D, comprising:

a main body, and at least one deformable contact element comprising a first portion, called the "contact portion", designed to apply, after the accessory has been assembled to said connector, a pressure on an electrically conductive surface of said connector, and a second portion designed to be in contact, after the accessory has been assembled to said connector, with said main body, said contact element being capable of providing an electrical connection between said portions.

The accessory according to the present invention is noteworthy in that it also comprises pressure means capable of deforming the contact element so as to be able to increase said pressure applied by the contact portion.

As will be seen in greater detail in the rest of the description, the accessory according to the invention may therefore comprise a contact element that opposes not at all, or very little, axially bringing the main body of the accessory and the connector closer together. The axial force that the operator has to apply when assembling the connector and the accessory therefore remains weak. Furthermore, the pressure on the conductive surface of the connector applied by the contact element is not limited to that resulting from its elasticity. At an appropriate moment, and particularly during or after the assembly operations, the pressure means make it possible to push the contact portion. By determining the conditions in which the pressure means will apply this pressure, it then becomes possible to ensure a higher contact pressure without this pressure making it more difficult to couple the accessory to the connector.

The accessory according to the invention may also comprise one or more of the following optional features:

The accessory is an accessory of the "backshell" type designed for assembly with a circular connector. An accessory of the "backshell" type is a casing being positioned behind a connector and ensuring the mechanical retention of cables, the electromagnetic shielding at the cables and the electrical continuity.

The pressure means are capable of moving said contact portion toward the axis D. In particular, said pressure may be applied substantially radially, in particular toward the axis A, so that the contact portion can press on a lateral surface of the connector.

The pressure means can be activated by actuating radial locking means of the main body relative to the connector, for example by screwing a fastening nut, and/or by axially bringing the accessory and the connector closer together. In particular, it is advantageous that these pressure means are activated systematically at a determined moment of assembling the accessory to the connector, particularly after the main body has been immobilized axially relative to the connector.

The pressure means are adjustable. Advantageously, the pressure of the contact portion on the conductive surface of the connector is therefore modifiable.

The contact element may be made of an electrically conductive material or be covered, at least in part, with a layer of such a material.

The contact element comprises a portion overlapping, at least in part, the main body of the accessory and/or a portion extending beyond the main body, substantially facing said contact portion. Preferably, the contact element comprises a shielding portion overlapping the main body of the accessory over the whole of its length.

Said contact portion is supported by a preferably elastic lug. The lug may extend substantially axially, particularly substantially along a notional cylinder with an axis D. The lug may be extended by a base extending on a substantially transverse plane, that is to say perpendicular to the axis D. The base itself may be extended, on the side opposite to the lug, by a substantially axial portion. Preferably, the substantially axial portion forms a shielding sleeve of the main body. This sleeve, for example a metal sheet part, preferably extends axially over the whole length of the main body of the accessory.

When the contact element forms a shield of the main body, the latter may advantageously be made of an electrically insulating material, no electrical conductivity being necessary any more. In particular, the main body may then be made of a thermoplastic material.

The accessory comprises a plurality of said lugs, preferably extending substantially parallel with one another, and, again preferably, secured to one another by a common base. The number of lugs can vary according to the diameter of the connectors. Preferably, the lugs are distributed substantially equiangularly about the axis D, that is to say that the pitch between the lugs is substantially constant. Preferably, the pitch "p" between two successive lugs is between 1 and 5 mm (see FIG. 1). The lugs and the common base may therefore form an axially aligned bracelet into which the connector can be inserted axially against the centripetal force applied by the elastic lugs.

The accessory comprises a ring capable of interacting with the main body in order to tightly grasp, or "pinch", the contact element, and notably, if necessary, the base of a lug or the common base securing said lugs to one another. Preferably, the ring and the contact element are made so that said contact element is pinched, between the ring and the main body, exclusively at the base of said lug or of said common base. The base of a lug or the common base does not necessarily extend along a substantially transverse plane, any other configuration being possible provided that, preferably, the pinching of said base or of said common base between the ring and the main body allows an elastic pressure on the electrically conductive surface of the connector. Such an elastic pressure constantly brings said lug or lugs to the bearing position, which advantageously confers a great reliability on this pressure.

It is preferable that the ring comprises means for coupling in rotation, about the axis D, said connector relative to the main body. The ring then forms an "antirotation" ring. The rotational coupling means may in particular comprise teeth and/or tenons. For example, the teeth and/or tenons are oriented axially. The tenons may be made to penetrate into matching housings made in the main body.

The ring may be electrically conductive. It is preferably made of an electrically insulating material, for example made of a composite material. Advantageously, the risk of an electric arc between teeth of the connector and matching teeth of the ring interacting with said teeth of the connector to provide said rotational coupling is then removed.

The accessory and/or the connector comprises radial locking means which may be made to be able to axially bring the main body and the connector closer together. The radial locking means may for example comprise a nut locked axially on the main body or the axial movement of which along this main body is limited, capable of interacting with a connector thread. Advantageously, a screw/nut system also makes it possible to axially lock the main body relative to the connector. The axial locking of the radial locking means may be provided by means of an elastic retention ring extending, for example, partly into each of two annular facing grooves, made in the nut and the main body. The annular grooves may be made in order to allow a limited axial movement of the retention ring.

The accessory comprises elastic return means, for example a crinkle washer inserted into an annular groove, capable of ensuring an automatic backward movement, toward the main body, of the radial locking means, in particular of the nut when it is separated (unscrewed) from the connector.

In a first embodiment, the ring and the main body are made so that said pinching can deform the contact element in a manner tending to increase said pressure applied by said contact portion. If said pressure is centripetal, that is to say comprises a component oriented towards the axis D, the deformation may, for example, tend to move said contact portion toward the axis D. Accordingly, in the region of pinching of the contact element, the ring and the main body may for example have, in cross section, convex and concave shapes respectively. Any shape allowing the pinching to cause a rotation of the lug toward the axis D would however be appropriate.

In a second embodiment, which is not incompatible with the foregoing, the contact element and the radial locking means are made so that a movement, for example axial and in the direction of the connector, of the radial locking means relative to the main body causes the radial locking means to push the contact portion of the electrical contact element in a direction tending to increase said pressure applied by said contact portion.

The invention also relates to a connection assembly comprising a connector, for example a circular connector, and an accessory designed to be assembled to this connector. This assembly is noteworthy in that the accessory complies with the invention.

This connection assembly may also comprise one or more of the following optional features:

The accessory may have one or more of the abovementioned optional features. Teeth of the ring of the accessory are then preferably made to interact with matching teeth of the connector so as to stop a rotation, about the axis D, of the connector relative to the main body.

Preferably the pressure means can be activated only at the end of radial and/or axial locking of the connector relative to the accessory. Such a radial locking may in particular result from the initial insertion of the connector into the accessory during assembly, for example by matching shape or use of a bracelet ensuring an axial alignment of these parts. Advantageously, the activation of the pressure means therefore does not hamper this insertion and therefore does not increase the axial force that the operator must apply for this purpose.

The connector is an electrically conductive material or is covered, at least partially, preferably completely, with a layer of such a material.

The conductive surface onto which the contact portion presses is a lateral surface.

In the first embodiment of the accessory, the radial locking means of the accessory are preferably made so that their activation can cause said pinching of said base between the ring and the main body of the accessory by pressure of the connector on the ring, said pinching deforming the contact element in a manner tending to create and/or increase said pressure applied by said contact portion.

In the second embodiment, the radial locking means of the accessory on the connector can be moved relative to the main body, after the ring has come into abutment with the connector. Preferably, the contact element and the radial locking means are made so that a movement of the radial locking means relative to the main body, for example on the axis D and in the direction of the connector, leads to the radial locking means pushing toward the axis D at least the contact portion, while the ring remains abutted against the connector. This movement of the locking means may preferably allow an adjustment of the pressure of the pressure means on the electrical contact element, and hence an adjustment of the pressure applied by the electrical contact element on the lateral contact surface of the connector.

The invention also relates to a method for assembling an accessory to a connector, the accessory comprising at least a deformable contact element of which at least a portion of electrical contact may be placed opposite an electrically conductive surface, for example a lateral surface, of the connector, the method comprising the following steps:

a) positioning the accessory and the connector so that said contact portion is facing said conductive surface of the connector;

b) increasing a pressure, possibly initially a zero pressure, tending to push the contact portion toward said conductive surface.

This method may also comprise one or more of the following optional features:

The step b) is carried out after the step a).

The accessory and the connector belong to a connection assembly according to the invention. The step b) may then be carried out by activating pressure means of the accessory so as to ensure a minimal pressure of the contact portion on said conductive surface of the connector.

In a first embodiment of the method, the contact portion is supported by a lug extended by a base inserted between a ring, preferably an antirotation ring, and a main body of the accessory, the surfaces of the ring and of the main body being, at said base, made so that a pinching of said base between these surfaces causes a deformation tending to push the contact portion toward the conductive surface of the connector. In the step b), preferably after abutting the ring against the connector, said pinching is brought about, for example by forcing said ring the main body to be axially brought closer together, particularly by screwing onto the connector a nut locked axially relative to the main body.

In a second embodiment of the method, in the step b), a nut is screwed onto the connector, the nut being made so that the movement of the nut toward the connector causes it to push the contact portion toward the conductive surface. Preferably, this pressure begins only after the connector has been axially immobilized relative to the accessory.

Other features and advantages of the invention will also appear in the description of the drawing supplied for descriptive purposes and being in no way limiting. In this drawing.

Figure 4A:
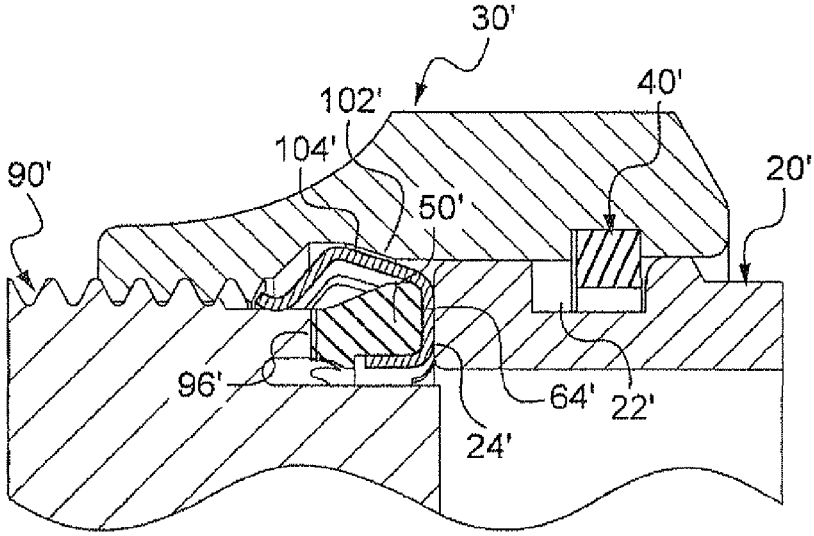
Figure 4B:
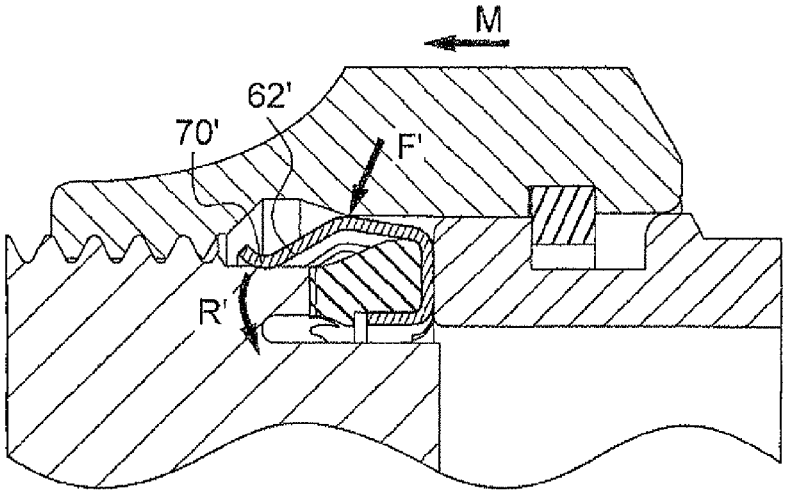

FIGS. 4*a* and 4*b* represent, in longitudinal section, an assembly according to the invention in a second embodiment, before and after activation of the pressure means, respectively.

In the various embodiments, the reference numbers are chosen to be identical in order to designate identical or similar members. In the second embodiment, they are however given a prime sign.

In the following description, the parts are described with reference to FIG. 1, which shows the axis D and, along this axis, the directions C, on the side of the connector, and A, on the side of the accessory.

Unless specified otherwise, "axially" means "on the axis D".

"Lateral surface" means a surface extending substantially parallel to the axis of assembly of the connector and the accessory.

"Radial locking means" of the main body relative to a connector refers to means capable of preventing any relative movement between these two parts in a direction perpendicular to the axis of assembly D, that is to say means allowing only a relative movement along this axis.

The axis of assembly is the main direction followed by the connector and the accessory when they are assembled. Conventionally, this axis, during assembly, is indistinguishable from the longitudinal axis of the connector and from that of the accessory.

"Deformable contact element" means a contact element which may be deformed by hand, in a manner that is visible to the naked eye. Preferably, the contact element comprises a lug one end of which is free and the other of which is attached to a base. It is then considered that the contact element is deformable when the possible movement of the free end, by manual deformation, is greater than 5%, preferably is approximately 10% of the distance between the two ends of the lug.

Figure 1:
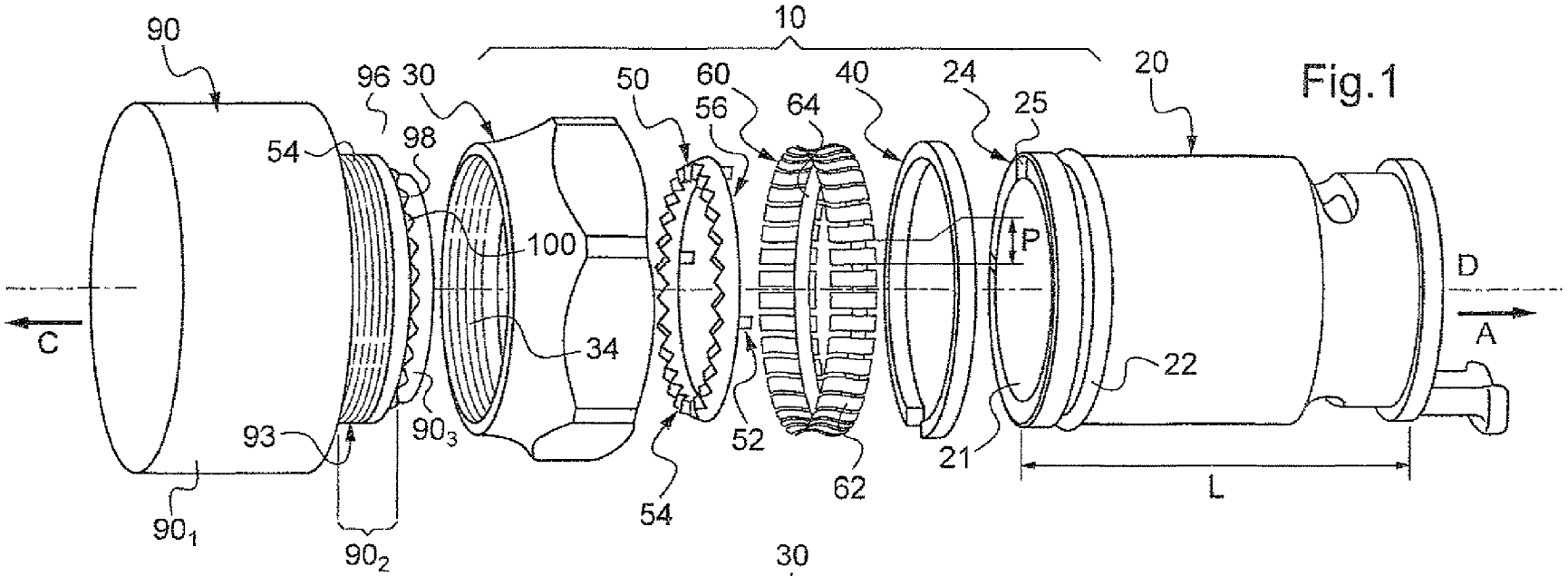
FIG. 1 represents in perspective an exploded view of an assembly according to the invention, according to a first embodiment.
Figure 2:
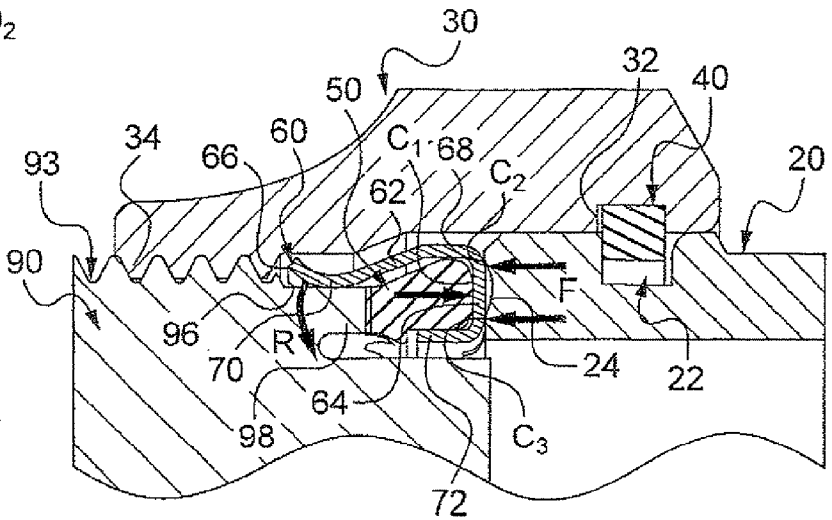
FIG. 2 represents, in longitudinal section, an assembly according to a first embodiment of the invention.

A first embodiment is shown in FIGS. 1 and 2. The accessory 10 shown comprises a main body 20 which has a generally tubular shape, with a substantially circular base. The central cavity 21 of the main body 20 is designed to accommodate the end of one or more electrical cables, not shown.

The main body 20 may be made of a conductive material or may be covered with a layer made of a conductive material.

At a first end of the main body, an annular groove 22 is made on the external lateral surface of the main body 20. The edge 24 of the main body 20, on the side C, comprises a plurality of housings 25.

The groove 22 is designed to accommodate a retention ring 40. Accordingly, the retention ring 40 is interrupted and has sufficient elasticity to be deformed when it is installed in the annular groove 22, then to substantially revert to its initial shape.

As shown in FIG. 2, after mounting, the retention ring 40 has an external diameter that is greater than the external diameter of the main body 20 immediately next to the annular groove 22, and an internal diameter smaller than this diameter. The internal diameter of the retention ring 40 is however greater than the diameter of the main body at the bottom of the annular groove 22. The retention ring 40 may therefore be retracted temporarily and elastically within the groove 22 in order to allow the nut 30 to be installed.

The nut 30 also has an annular groove 32 that can be placed opposite the annular groove 22 of the main body 20, as shown in FIG. 2. The retention ring 40 therefore serves as an axial locking means of the nut 30 relative to the main body 20. Axially, in the direction C, the nut 30 extends beyond the main body 20 and has an internal thread 34 allowing the nut to be screwed onto a connector.

The accessory according to the invention also comprises a ring 50 allowing a rotary coupling of the main body 20 and of the connector to be assembled to the accessory. Accordingly, the ring 50 has tenons 52 extending substantially axially and capable of entering the housings 25 of substantially matching shapes made in the edge 24 of the main body 20. The insertion of the tenons 52 into the housings 25 prevents any rotation of the main body 20 relative to the ring 50.

On the side opposite to the tenons 52, the ring 50 has a toothed portion consisting of a plurality of substantially axial teeth 54. These teeth 54 are made so as to mesh with matching teeth made on the connector.

On the side A, the ring 50 has a face 56 which, in longitudinal section, has a convex profile. In other words, the face 56 of the ring 50 has a convex semi-toric shape.

Preferably, the ring 50 is made of an electrically insulating material, which advantageously makes it possible to remove any formation of an electric arc on the teeth 54 and 100.

The accessory 10 according to the invention also comprises a bracelet 60 formed of a plurality of lugs 62 extending substantially parallel to the axis D and connected to one another via a common base 64 extending substantially on a transverse plane, that is to say perpendicular to the axis D.

The lugs 62 extend mainly along a notional cylinder with an axis D. In cross section, as shown in FIG. 2, they have an S-shaped section whose first end 66 and second end 68 respectively are free and connected to the base 64 respectively. The belly of a lug 62 close to the first end 66 forms a contact portion 70 designed to enter into contact with an external lateral surface of the connector.

The bracelet 60 may be made of an electrically conductive material or covered, at least partly, with an electrically conductive material so as to ensure an electrical connection at least between the contact portion 70 and a portion of the bracelet 60 in contact, after the accessory has been assembled with the connector, with the main body 20.

On the side opposite to the lugs 62, the base 64 has a rim 72 extending substantially along a notional cylinder with an axis D. All of the lugs 62, the base 64 and the rim 72 thereby define a substantially axial annular groove capable of accommodating the ring 50, as shown in FIG. 2.

The base 64 has orifices or notches, not shown, that the tenons 52 can pass through so that the latter can be housed in the housings 25 of the main body 20.

The edge 24 of the main body 20 has, at least in the region of pinching of the bracelet 60 with the ring 50, a concave semi-toric section.

The connector 90 has a stepped cylindrical shape.

In the direction A of the accessory 10, the connector 90 has successively:

- a first cylindrical section $\mathbf{90}_1$ with an external diameter $D_1$,
- a cylindrical section $\mathbf{90}_2$ with an external diameter $D_2$ smaller than $D_1$, comprising successively a thread 93 and an electrically conductive lateral surface 96 that is substantially smooth,
- a third cylindrical section $\mathbf{90}_3$ with an external diameter $D_3$ smaller than $D_2$.

The thread 93 is able to interact with the internal thread 34 of the nut 30.

The conductive surface 96, that is cylindrical with an axis D, is designed, as shown in FIG. 2, to enter into contact with the contact portion 70 of the lugs 62 of the bracelet 60. It may also accommodate a seal, not shown.

Preferably, the external diameter of the conductive lateral surface 96 is slightly larger than the internal diameter of the bracelet 60 at the contact portions 70. Simply the insertion of the connector 90 between the lugs 62 therefore already ensures, due to the elasticity of the lugs 62, a minimal contact pressure between the contact portions 70 and the conductive surface 96.

The connector 90 has a crank 98 connecting the second and third cylindrical sections $\mathbf{90}_2$ and $\mathbf{90}_3$ and provided with substantially axial teeth 100 shaped to interact with the teeth 54 of the ring 50 in order to ensure a rotational coupling between the connector 90 and the ring 50.

As shown in FIG. 2, the crank 98 is shaped in order to serve as an abutment to the ring 50 when the connector and the accessory are assembled.

The connector 90 is usually made of an electrically conductive material.

In order to install the accessory 10 according to the invention, the base 64 of the bracelet 60 is first placed on the edge 24 of the main body 20 in an angular position allowing the subsequent insertion of the tenons 52 of the ring 50 into the housings 25. The ring 50 is then housed in the bottom of the axial groove defined by the bracelet 60, as shown in FIG. 2, so that the tenons 52 enter the housings 25. Preferably, the ring 50 has a shape requiring a forced installation, against the elastic force applied by the lugs 62, in order to be placed at the bottom of the axial groove of the bracelet 60. Advantageously, the bracelet 60 therefore axially locks the ring 50 in the axial groove of the bracelet 60. The nut 30 is then mounted onto the main body 20. Accordingly, the retention ring 40 is first deformed so as to be able to be placed in the annular groove 22 of the main body. The main body 20 is then inserted into the nut 30, until the nut 30 comes into abutment with the retention ring 40. The ring 40 is then forced into the groove 22 so as to allow an axial movement of the nut in the direction A until the annular groove 32 is facing the annular groove 22. The elasticity of the retention ring allows it then to enter the annular groove 32 of the nut, thereby axially locking the nut 30 relative to the main body 20. Preferably, the diameter of the bracelet 60 at the free end 66 of the lugs 62 is greater than the internal diameter of the nut 30 at the internal thread 34. Advantageously, the axial immobilization of the nut on the main body 20 therefore allows simultaneously an axial retention of the bracelet 60 relative to the main body 20.

The accessory thus installed can be assembled to the connector 90.

Accordingly, the nut 30 is screwed onto the thread 93 of the connector. This screwing provides a radial locking and axial guidance making it easier to insert the lateral conductive surface 96 between the lugs 62 of the bracelet 60. Screwing is continued up to the position shown in FIG. 2. The electrical contact between the contact portion 70 of the lugs 62 and the lateral conductive surface 96 of the connector 90 is then provided by the elasticity of the lugs 62.

To prevent this elasticity excessively opposing the axial closing of the connector 90 and the main body 20, this pressure must however be limited.

In the position of FIG. 2, the base 64 of the bracelet 60 is in contact with the face 56 of the ring 50, in a circle $C_1$, and on the other hand with the edge 24 of the main body 20 in two circles $C_2$ and $C_3$, coaxial with the circle $C_1$ and having diameters that are larger and smaller, respectively, than the diameter of $C_1$. In this position, the ring 50 is in abutment with the crank 98, the teeth 54 and 100 being meshed so as to rotationally couple the connector 90 and the ring 50.

When the operator continues screwing the nut 30 onto the connector 90, the base 64 of the bracelet 60 sustains a pinching of increasing amplitude between the ring 50, in axial abutment on the crank 98, and the main body 20 drawn in the direction C of the connector by the nut 30, via the retention ring 40. This pinching of increasing amplitude, shown by the three arrows F in FIG. 2, tends, because of the matching semi-toric shapes of the face 56 of the ring 50 and of the edge 24 of the main body 20, to deform the base 64, and therefore to push the contact portion 70 of the lugs 62 toward the axis A (arrow R). The adjustment of the amplitude of pinching, by rotating the nut 30 beyond the position shown in FIG. 2, advantageously makes it possible to modify the pressure of the contact portion 70 of the lugs 62 on the cylindrical conductive surface 96 of the connector. This adjustment is possible even though the cylindrical surface 96 has already been inserted between the lugs 62 of the bracelet 60. It therefore does not oppose the axial force that the operator must apply during this insertion.

It now seems clear that, in the event of a lightning discharge, the route of the electric current between the circular connector 90 and the metal lugs 62 and between the metal lugs 62 and the main body 20 of the accessory is via clear electrical contacts, and preferably many of them. The risk of damage is therefore considerably reduced, in particular if the ring 50 is made of an electrically insulating material, at least at the teeth 54.

In addition, the pressure of the lugs 62 on the conductive surface 96 and the pressure between the base 64 of the bracelet 60 and the main body 20 of the accessory 10 may be adjusted to the desired level simply by tightening the locking nut, irrespective of the initial pressure applied by the lugs 62, opposing the insertion of the connector 90 between the lugs 62. This initial pressure may therefore advantageously remain low, or even zero.

After assembly, the axes of assembly D of the main body 20, of the nut 30, of the ring 50, of the bracelet 60 and of the connector 90 are substantially indistinguishable.

Figure 3:
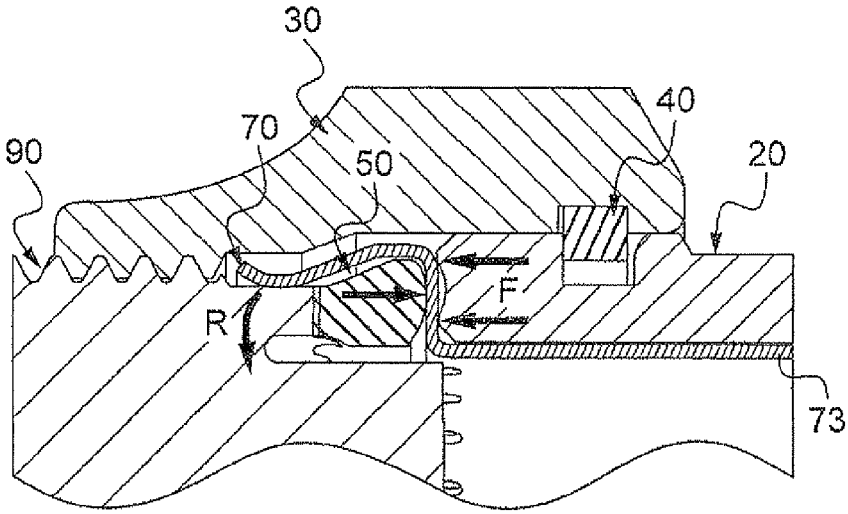
FIG. 3 represents, in longitudinal section, a variant of the first embodiment of an assembly according to the invention.

FIG. 3 represents a variant of the embodiment of the invention described above. This embodiment differs in that the base 64 of the bracelet 60 is extended, on the side opposite to the lugs 62, in the direction A. Preferably, it is extended in the form of a cylindrical sleeve 73 made of a conductive material extending preferably over the whole length L of the main body 20. Advantageously, this sleeve, which may be a piece of metal sheet, may therefore form a shield. The main body 20 may then be made of an insulating material, for example identical to that of the ring 50, such as a thermoplastic. The cylindrical sleeve 73 may be closed, that is to say have in cross section a continuous circular section, or be open.

FIGS. 4*a* and 4*b* represent a second embodiment of the invention. Unlike the preceding embodiments, the increase in the contact pressure does not result from a pivoting of the lugs under the effect of a pinching of the base 64 between the ring 50 and the main body 20. In this embodiment, the base 64', the edge 24' and the face 56' may all extend in parallel, in transverse planes. The increase in pressure results from a pressure F' of a shoulder 102' of the nut 30' on a protruding external surface 104' of the lugs 62' when the nut is moved axially M on the main body 20.

As shown in FIGS. 4*a* and 4*b*, at least one of the annular grooves of the nut and of the main body, in this instance the groove 22', is widened so as to allow the nut 30' to be screwed onto the connector 90' after the ring 50' has been sandwiched, with the base 64' of the bracelet 60', between the crank 98' of the connector 90' and the edge 24' of the main body 20'. This position, shown in FIG. 4*a*, can be obtained without the operator having to apply a high axial force. To insert the conductive lateral surface 96' between the lugs 62', he in fact has to fight only against the elasticity of the lugs 62', which may be low or even zero.

By continuing screwing the nut 30', the operator brings the shoulder 102' to push against the surface 104' of the teeth 62', as shown in FIG. 4*b* (arrow F'). This pressure tends to cause the contact portions 70' of lugs 62' to pivot toward the axis D (arrow R') and results in an increase in the pressure applied by the contact portion 70' of the lugs 62' on the conductive surface 96. Advantageously, the contact pressure applied by the lugs 62' on the surface 96 may therefore be increased and adjusted to a desired level after final positioning of the main body 20', of the ring 50' and of the connector 90'.

Naturally the present invention is not limited to the embodiments described and represented, supplied as illustrative and nonlimiting examples.

In particular, the various embodiments could be combined.

Moreover, the moment when the pressure applied by the contact portion is increased is not necessarily after the axial placing in contact of the connector, of the ring, of the bracelet and of the main body. For example, in the second embodiment, the allowed movement of the retention ring 40' may be limited or even zero. The increase in pressure beyond simply the pressure due to the elasticity of the lugs will then occur at the same time as this axial placing in contact.

The invention claimed is:

1. A connection assembly comprising a connector having an electrically conductive surface and an accessory designed to be assembled to said connector on an assembly axis, said accessory comprising:

a main body, and at least one deformable contact element comprising:

a first portion, or a contact portion, supported by a lug and configured to apply, after the accessory has been assembled to said connector, a pressure on said electrically conductive surface of said connector, and a second portion, or a base, extending said lug, substantially extending in a plane perpendicular to said assembly axis, and configured to be in contact with said main body after the accessory has been assembled to said connector, aid contact element being configured to provide an electrical connection between said first and second portions, pressure means configured to deform the contact element so as to increase said pressure applied by the contact portion after the accessory has been assembled to said connector, said assembly also comprising a ring pinching said base with the main body.

2. The assembly as claimed in claim 1, wherein the accessory is an accessory of a backshell type designed for assembly with a circular connector.

3. The assembly as claimed claim 1, wherein the pressure means are configured to move said contact portion toward the axis.

4. The assembly as claimed in claim 1, wherein the pressure means are configured to be activated by actuating radial locking means and/or by axially bringing the accessory and the connector closer together.

5. The assembly as claimed claim 1, wherein the pressure means are adjustable so as to modify the increase of said pressure.

6. The assembly as claimed in claim 1, wherein the contact element comprises a portion overlapping, at least in part, the main body of the accessory and/or a portion extending beyond the main body, substantially facing said contact portion.

7. The assembly as claimed in claim 6, wherein the contact element comprises a portion overlapping the main body of the accessory over the whole of its length.

8. The accessory as claimed in claim 7, wherein the main body is made of an electrically insulating material.

9. The assembly as claimed in claim 1, wherein the pinching of said base between the ring and the main body enables an elastic pressure on the electrically conductive surface of the connector.

10. The assembly as claimed in claim 9, further comprising a plurality of said lugs, extending substantially parallel with one another.

11. The assembly as claimed in claim 1, wherein said base is common to all said lugs.

12. The assembly as claimed in claim 9, in which said contact element is pinched between the ring and the main body exclusively at the base of said lug.

13. The assembly as claimed in claim 1, wherein the ring is made of an electrically insulating material.

14. The assembly as claimed in claim 1, wherein the ring and the main body are made so that said pinching can deform the contact element in a manner tending to increase said pressure applied by said contact portion.

15. The assembly as claimed in claim 14, wherein in the region of pinching of the contact element, the ring and the main body have, in cross section, convex and concave shapes, respectively.

16. The assembly as claimed in claim 1, wherein the ring comprises means for coupling in rotation, about the axis D, said connector relative to the main body.

17. The assembly as claimed in claim 4, wherein the radial locking means of the accessory are made so that their activation can cause said pinching of the contact element between said ring and the main body of the accessory by pressure of the connector on the ring.

18. The assembly as claimed in claim 4, wherein the radial locking means can be moved relative to the main body, after the ring has come into abutment with the connector, the contact element and the radial locking means being made so that a movement of the radial locking means relative to the main body causes the radial locking means to push said contact portion so as to increase said pressure, while the ring remains butted against the connector.

19. The assembly as claimed in claim 4, wherein the pressure means are configured to be activated only after the axial and/or radial locking of the connector relative to the accessory.

20. A method for assembling an accessory to a connector of a connection assembly complying with claim 1, the method comprising the following successive steps:

a) positioning the accessory and the connector so that said contact portion is facing said conductive surface of the connector; and b) increasing a pressure tending to push the contact portion toward said surface.

21. The assembly method as claimed in claim 20, wherein step b) is carried out by deforming the contact element by pinching between the ring of the accessory and the main body and/or by screwing onto the connector a nut made so that the movement of the nut toward the connector causes it to push the contact portion toward said surface.

22. A connection assembly comprising a connector having an electrically conductive surface and an accessory designed to be assembled to said connector on an assembly axis, said accessory comprising:

a main body, and at least one deformable contact element comprising:

a first portion, or a contact portion, supported by a lug and configured to apply, after the accessory has been assembled to said connector, a pressure on said electrically conductive surface of said connector, and a second portion, or a base, extending said lug, substantially extending in a plane perpendicular to said assembly axis, and configured to be in contact with said main body after the accessory has been assembled to said connector, said contact element being configured to provide an electrical connection between said first and second portions, pressure means configured to deform the contact element so as to increase said pressure applied by the contact portion after this accessory has been assembled to said connector, said assembly also comprising a ring pinching said base with the main body, said assembly comprising radial locking means configured to prevent a radial movement of the main body relative to said connector, wherein the contact element and the radial locking means are made so that a movement of the radial locking means relative to the main body causes the radial locking means to push the contact portion in a direction tending to increase said pressure applied by said contact portion.

23. The assembly as claimed in claim 22, wherein the radial locking means comprise a nut, locked axially on the main body or the axial movement of which along this main body is limited, configured to interact with a connector thread.

24. The assembly as claimed in claim 22, comprising an elastic retention ring configured to axially lock or limit the axial movement of the radial locking means relative to the main body.

25. The assembly as claimed in claim 23, comprising means for elastically returning the nut to the main body after separation of the nut and the connector.

* * * * *